United States Patent [19]

Albright

[11] Patent Number: 4,809,877

[45] Date of Patent: Mar. 7, 1989

[54] MEDICAMENT CAPSULE DISPENSING DEVICE

[76] Inventor: Marie O. Albright, 7356 Northstar, Twenty-Nine Palms, Calif. 92277

[21] Appl. No.: 670,858

[22] Filed: Aug. 14, 1987

[51] Int. Cl.[4] ..... B65D 83/04

[52] U.S. Cl. ..... 221/75; 221/82; 221/121

[58] Field of Search ..... 221/15, 75, 82, 83, 221/86, 103, 121, 197; 368/10

[56] References Cited

U.S. PATENT DOCUMENTS

| | | | |
|---|---|---|---|
| 1,038,668 | 9/1912 | Sheehan | 221/75 |
| 2,595,456 | 5/1952 | Hinkel | 221/82 X |
| 4,674,651 | 6/1987 | Scidmore et al. | 221/15 X |

*Primary Examiner*—F. J. Bartuska
*Attorney, Agent, or Firm*—Frederick Gotha

[57] ABSTRACT

A device for dispensing medicament capsules is set forth which includes a housing within which are disposed a plurality of vertically spaced and substantially parallel transverse dispensing gates. Each dispensing gate has a like number of apertures extending vertically through the gate and spaced at different radial distances from the housing axis where the radial distances are of equal length in each one of the plurality of gates. Those apertures located at equal radial distances in successive dispensing gates are spaced in a radial sequence of equal angles. Between each successive dispensing gate a removable and reloadable carriage member is located which is contiguous with the dispensing gate and each carriage member has a multiplicity of radially spaced slots extending vertically througth the carriage member for storage of medicament capsules. The slots are sequentially located concentrically about the vertical axis at radial distances equal to those radial distances locating a dispensing gate aperture. The carriage members are connected together to permit vertical alignment of the carriage member slots such that upon rotation of the carriage members, the slots remain in vertical alignment. A programmable motor is also provided to index or rotate the carriage members whereby upon open alignment of any carriage member slot with a dispensing gate aperture the capsules contained in the slot will pass downwardly through the dispensing gate.

15 Claims, 9 Drawing Sheets

Fig. 15
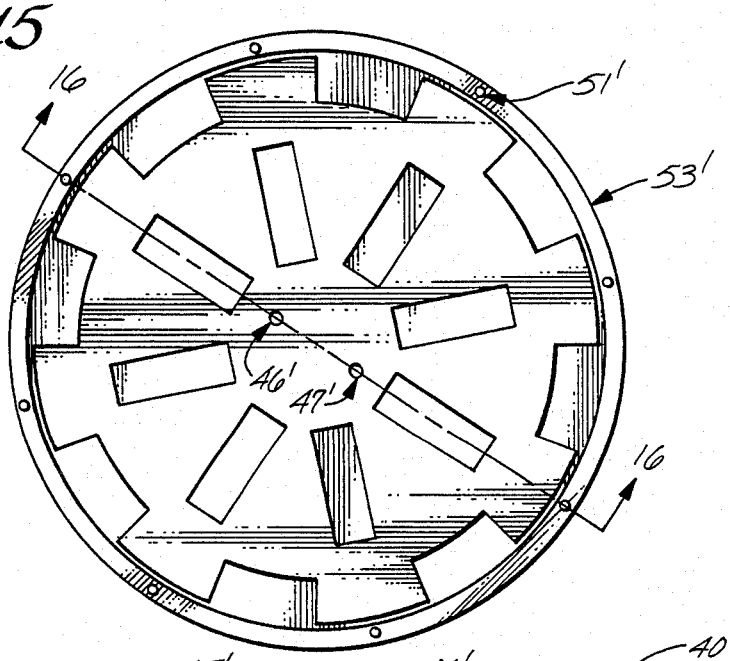
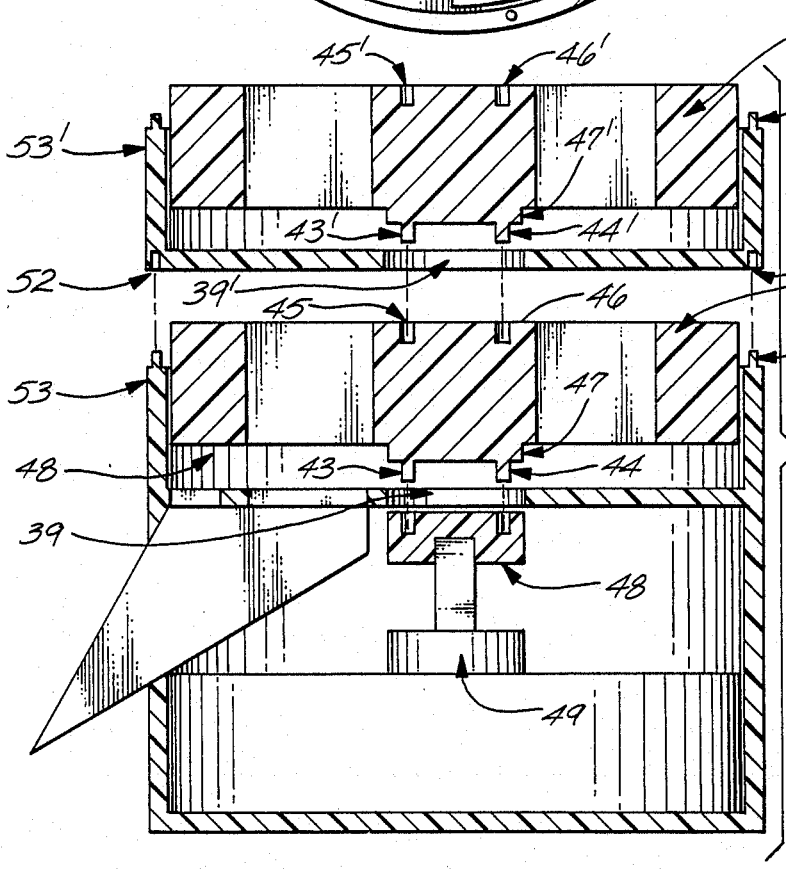
Fig. 16

MEDICAMENT CAPSULE DISPENSING DEVICE

FIELD OF THE INVENTION

This invention relates to a device for dispensing medicament capsules or pills on a timely basis.

BACKGROUND OF THE INVENTION

Prescribed medicine which requires a series of pills or different types of pills to be taken at regular intervals presents an organizational problem to many patients who are unable to devise a system for systematic adherence to a prescription schedule. Utilizing a container which requires manual removal of capsules or pills on a regular basis from identified particular chambers within the container requires awareness on the part of the patient of the times when the prescribed capsules or pills are to be taken. Containers of this type require the patient to be aware of the prescription schedule for taking medication in order to be effective. However, when patients are required to take multiple forms of medicament at regular intervals, the organizational process, particularly for elderly patients, is difficult and in many instances, unmanageable.

SUMMARY OF THE INVENTION

There is, therefore, provided according to the present invention, a device for dispensing medicament capsules or pills to alleviate the rigorous scheduling required when medication must be taken periodically and particularly so when a variety of pills must be taken by a patient on a routine scheduled basis.

The present invention is directed to a device for dispensing medicament capsules periodically at a predetermined rate. The device is composed of a housing which has a vertical axis and a plurality of axially spaced dispensing gates disposed within the housing. Each dispensing gate is of similar construction and has a like number of apertures which extend vertically through the gate. In a particular dispensing gate each aperture is spaced at a different radial distance from the vertical axis and is so dimensioned and proportioned to permit the passage of capsules therethrough; the radial distances locating each such aperture are of equal length in each one of said plurality of gates. The locations, therefore, of the apertures in each gate are similar but the gates are so positioned and arranged in the housing that those particular apertures which are located at equal radii are axially spaced in a radial sequence of equal angles.

Intermediately located between successive dispensing gates is a carriage member for carrying the medicament capsules where the carriage is contiguous with at least one dispensing gate. Each carriage member is mounted for rotation within the housing and has a multiplicity of slots which extend vertically through the carriage member and the slots are sequentially located on concentric circles about the vertical axis where the radii of the concentric circles are equal to the radial distances at which the apertures are located in the dispensing gate. The slots are so dimensioned and proportioned to permit the capsules contained in any slot to pass downwardly through an aperture when the slot is in contiguous alignment with the aperture.

The carriage members are identically constructed such that when the carriage members are positioned in the housing the slots are vertically aligned and remain so aligned during rotation of the carriage members. In the preferred embodiment of the invention the carriage members have a non-circular hole centrally located and extending vertically through the carriage member for receiving a shaft which has a con-circular cross-section such that upon rotation of the shaft the carriage members rotate at the same angular velocity as the shaft.

In another embodiment of the invention, the housing comprises a series of cup shaped members having cylindrical sidewalls extending from a transverse base which defines a dispensing gate. The cup shaped members have a plurality of fingers extending axially from the cylindrical sidewalls for insertion in coupling cavities located in the base of an adjacent cup shaped member. The transverse base has an annular opening which is centrally located with the axis as the center of the opening thus permitting interconnection of successive carriage members.

In order for a pill to be transferred from a carriage through a aperture into a slot of a succeeding lower carriage, there must be contiguous alignment of a slot with an aperture in the dispensing gate. The dispensing gates do not rotate and the apertures are fixed spatially relative to the housing of the dispensing device. A motor means carried by the housing is programmed to rotate or index the carriages in a predetermined number of degrees after a programmed laspe of time where the degrees of rotation are equal to the number of degrees between successive carriage slots. When the carriages are loaded with capsules, certain slots remain empty of capsules to permit the sequential transfer of capsules through the aligned carriage slots.

BRIEF DESCRIPTION OF THE DRAWINGS

These and other features and advantages will become appreciated as the same become better understood with reference to the following specification, claims and drawings wherein:

FIG. 15 is a top view of the embodiment of the invention referred to in FIG. 14.

FIG. 16 is a sectional view of FIG. 15, taken along the line F—F.

DETAILED DESCRIPTION

Figure 1:
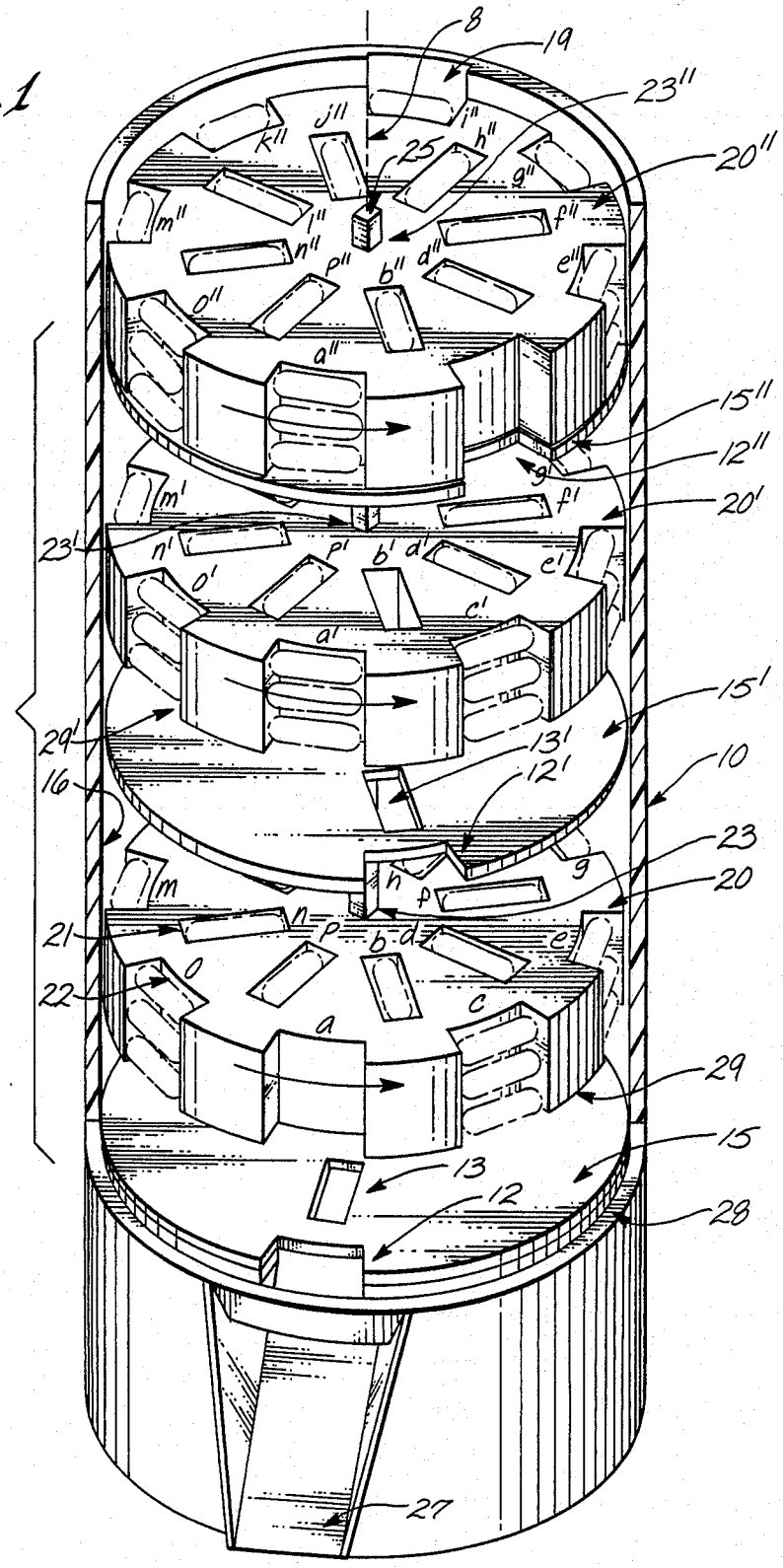
FIG. 1 is an exploded perspective illustration of one embodiment of the medicament dispensing device according to the present invention and illustrates the time zero position of the carriages in the dispensing sequence.
Figure 2:
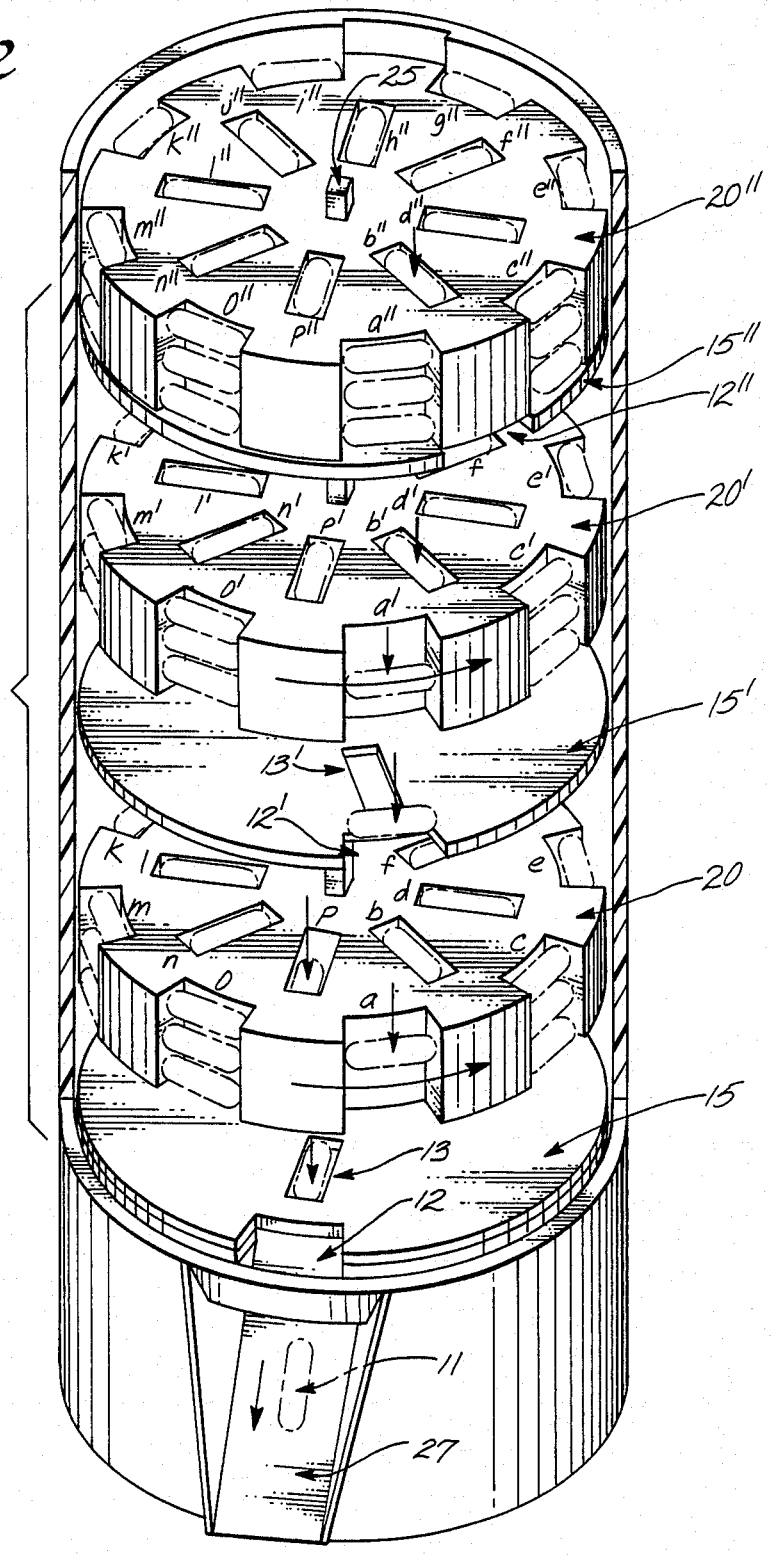
FIG. 2 is an exploded perspective illustration of the device shown in FIG. 1, where the carriages are illustrated in the second position of the dispensing sequence.
Figure 3:
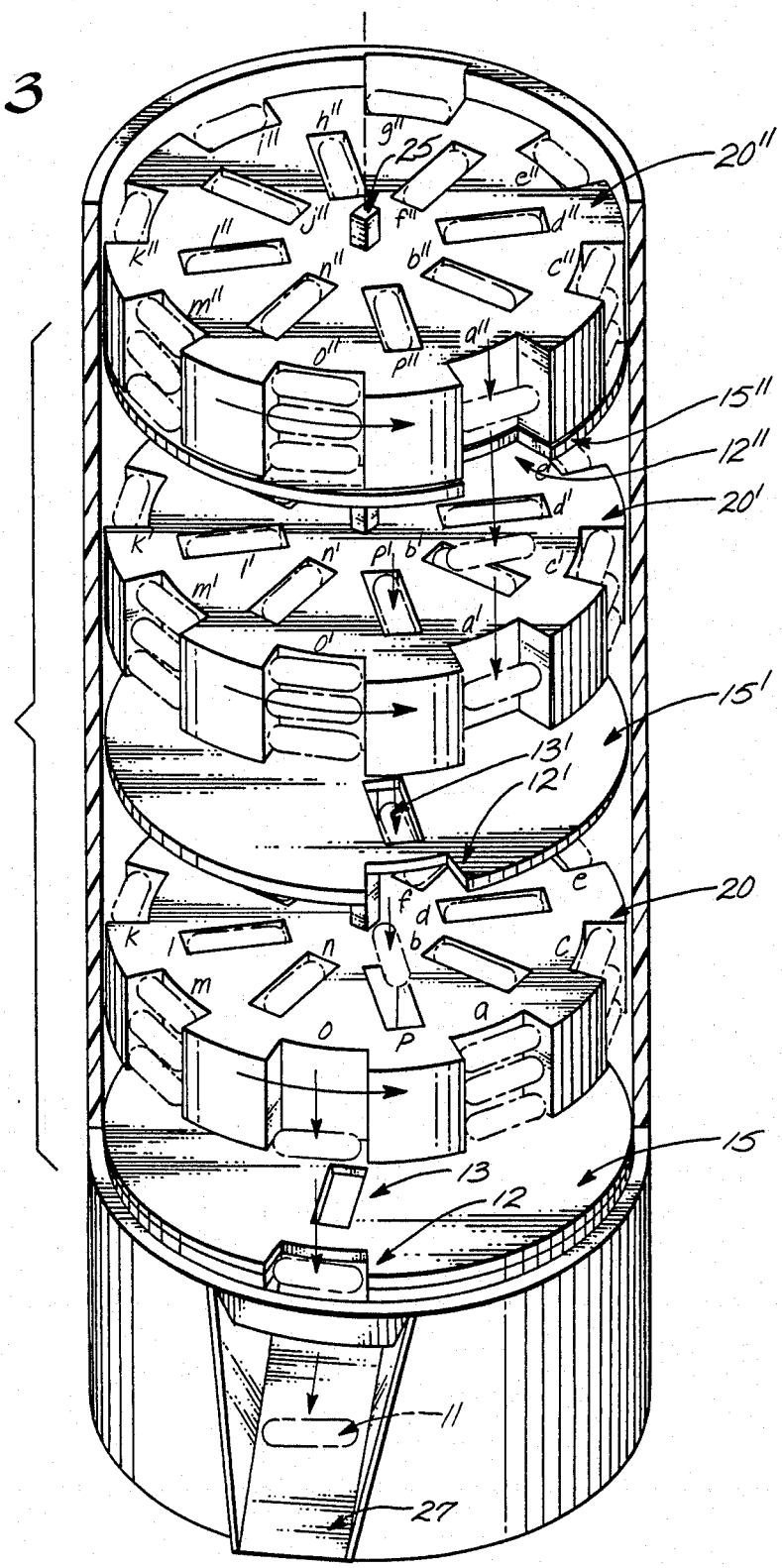
FIG. 3 is an exploded perspective illustration of the device shown in FIG. 1, where the carriages are illustrated in the third position in the dispensing sequence.
Figure 4:
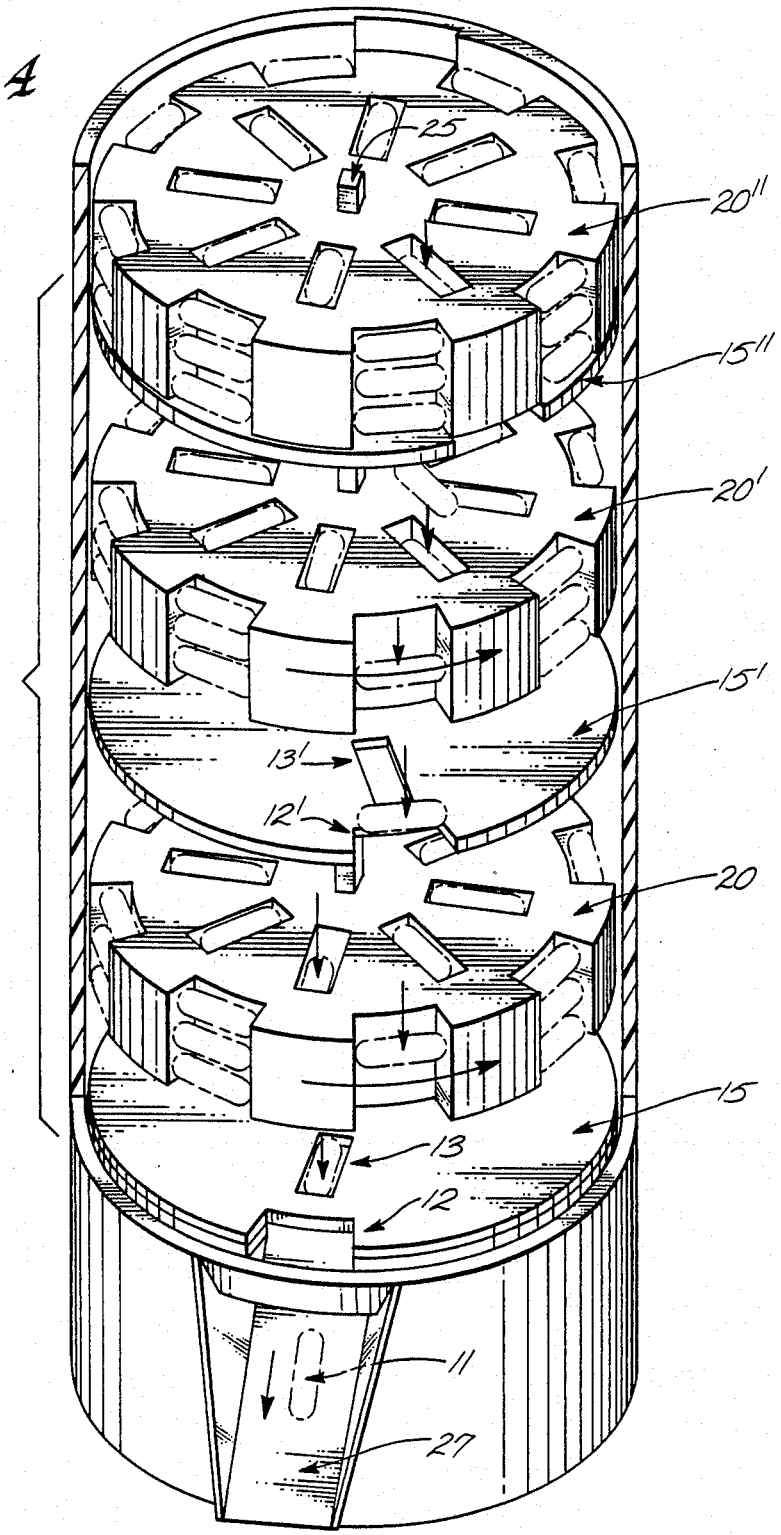
FIG. 4 is an exploded perspective illustration of FIG. 1, where the carriage is in the fourth position of the dispensing sequence.

Referring to FIG. 1, an exploded perspective view of the preferred embodiment of the invention is shown in a partial sectional view. FIGS. 2, 3 and 4 are also partial sectional views of the invention in exploded perspective illustrating internal events which occur sequentially within the housing 10 whereby medicament capsules 11 are dispensed sequentially through inner aperture 13 and outer perphieral aperture 12 in a predetermined time sequence. Apertures 12 and 13 extend vertically through dispensing gate 15 which is a thin circular plate in the preferred embodiment of the invention and is tangential to the inner wall 16 of housing 10. Similarly, dispensing gates 15' and 15" have inner apertures 13' and 13" and outer perpherial apertures 12' and 12".

Figure 7:
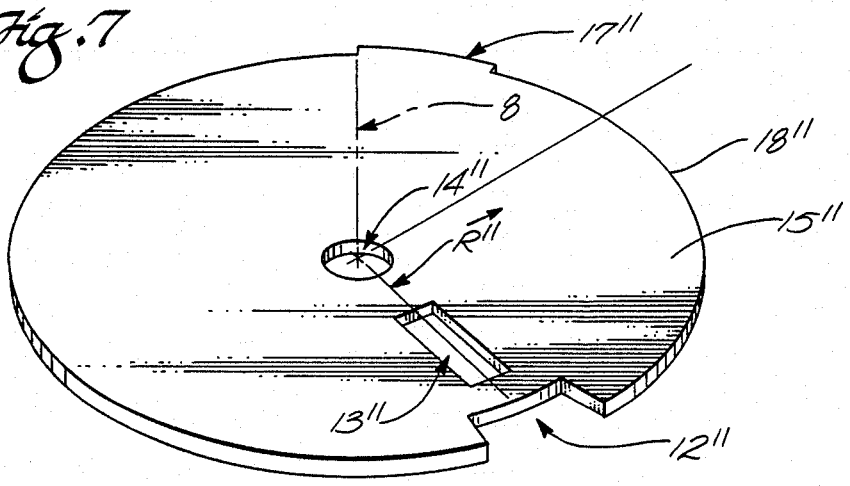
FIGS. 5, 6 and 7 are perspective illustrations of the dispensing gates in the preferred embodiment of the invention, illustrating the angular sequence of the apertures in an axial direction.
Figure 6:
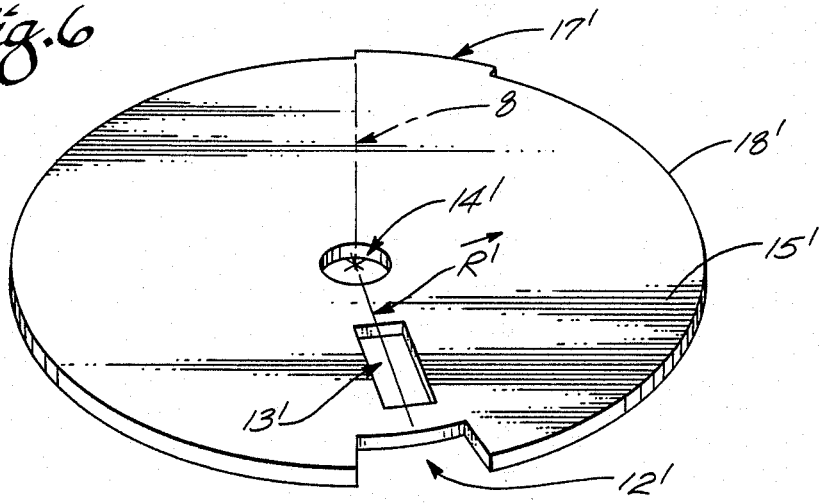
Figure 5:
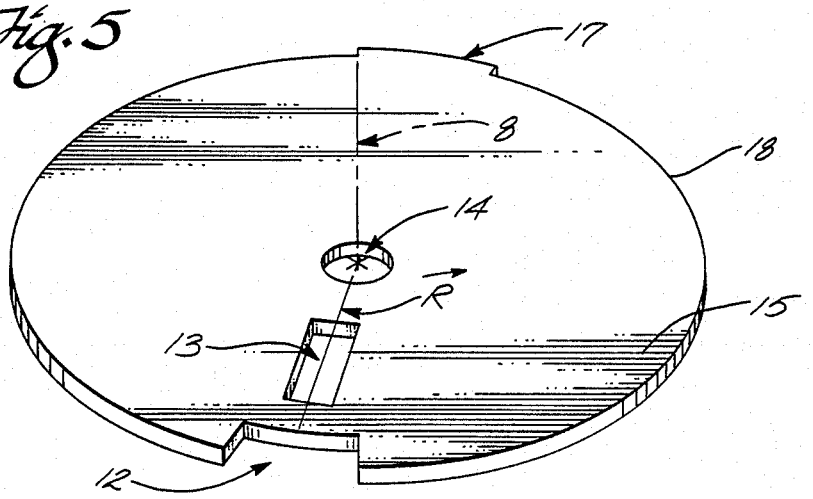

FIGS. 5, 6 and 7 illustrate the spatial relationship between dispensing gates 15, 15' and 15" and particularly demonstrate the angular sequence of apertures 12, 12' and 12" and also apertures 13, 13' and 13". In the preferred embodiment, the dispensing gates have tabs 17, 17' and 17" located on the outer periphery 18, 18' and 18" of the respective dispensing gates. Tabs 17, 17' and 17" insert into an axially extending channel 19 located on the innerwall 16 of the housing 10 such that relative rotation between the dispensing gate and the housing is precluded upon insertion of the tab into channel 19. The angular sequence of the apertures in the preferred embodiment is 22½ degrees at each successive dispensing gate ascending vertically from dispensing gate 15. In the preferred embodiment, the apertures are located and constructed symmetrically along a radius vector R extending radially from the axis of the dispensing gate where said axis is coaxial with the vertical axis 8 of the housing. Apertures 12 and 13 are symmetrical about radius vector R in dispensing gate 15 in the preferred embodiment of the invention and apertures 12' and 13' and apertures 12" and 13" are symmetrical about radius vectors R' and R" as can be seen in FIGS. 6 and 7. Apertures 12 and 13 may be located on different radius vectors in other embodiments of this invention. In such circumstances, the inner gate aperture must be sequenced in each successive dispensing gate the same number of degrees as the outer peripheral apertures are sequenced.

Referring again to FIG. 1, it can be seen that located between dispensing gates 15 and 15' is carriage 20 which contains a plurality of inner slots 21 that are equiangularly spaced about the axis of carriage 20 where said axis is coaxial with the vertical axis of housing 10. Inner slots 21 are radially located at the same radial distance as the inner apertures of the dispensing gates are located from the axis. Additionally, carriage 20 contains a plurality of outer peripheral slots 22 which are equiangularly spaced at the outer periphery of the carriage 20. Similarly, carriage 20' is spaced between dispensing gates 12' and 12" and contiguous with said gates. Carriage 20" is positioned above dispensing gate 12" in a vertical direction and is contiguous with dispensing gate 15".

Figure 13:
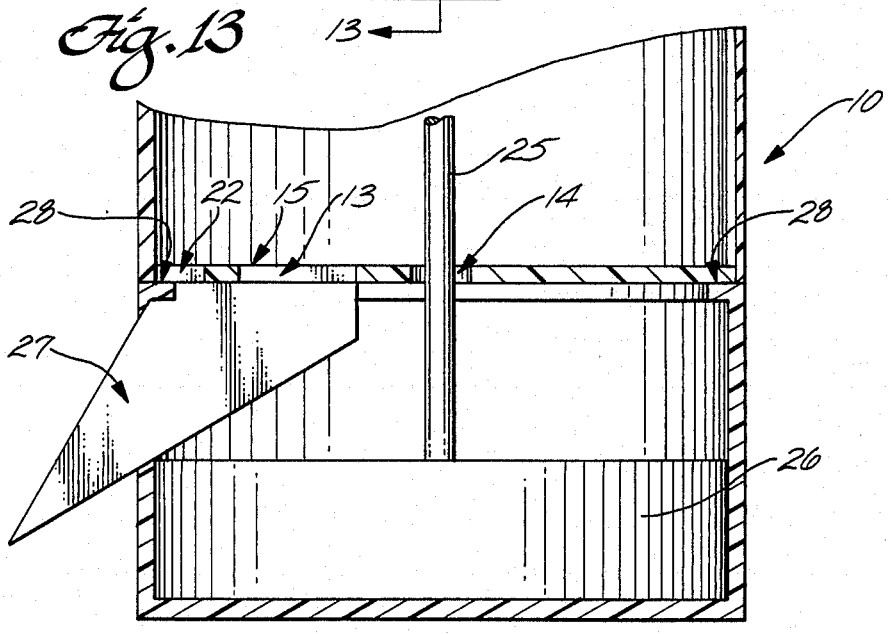
FIG. 13 is a sectional view taken along the line E—E of FIG. 12.

In order to permit vertical alignment of the outer peripheral slots of each carriage and the vertical alignment of the inner slots of each carriage, a noncircular opening 23 is provided in each carriage and extends axially therethrough. A shaft 25 of noncircular cross-section extends axially through each carriage such that upon rotation of shaft 25 carriages 20, 20' and 20" will rotate at the same angular velocity as the shaft. In the preferred embodiment shaft 25 has a square cross-section and the openings 23, 23' and 23" in the carriages are also of square cross-section. A programmable motor means 26 which is shown in FIG. 13 may be programmed to rotate shaft 25 at a predetermined periodic rate to index shaft 25 through an angle equal to the number of degrees between slots 21 and 22.

Figure 8:
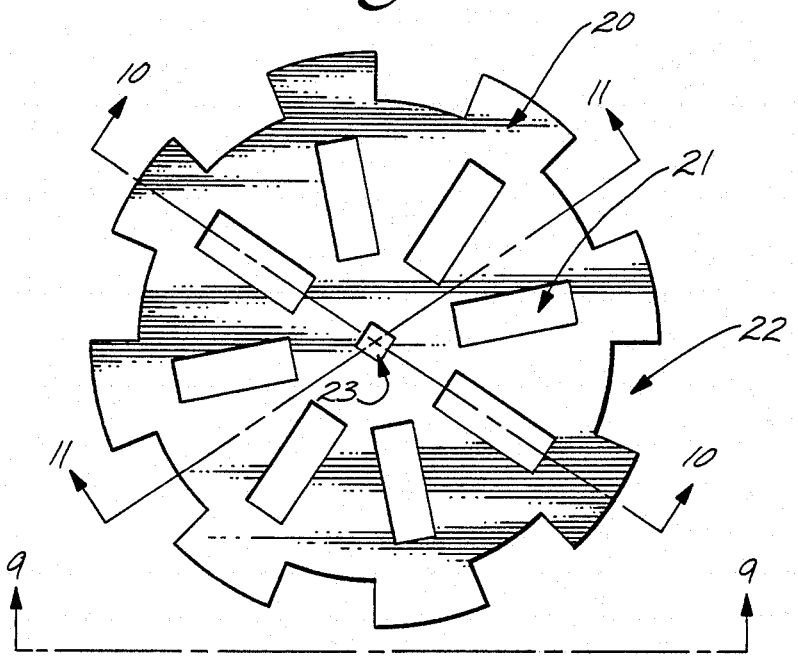
FIG. 8 is a top view of one of the plurality of the carriage members which are shown in perspective in FIG. 1.
Figure 9:
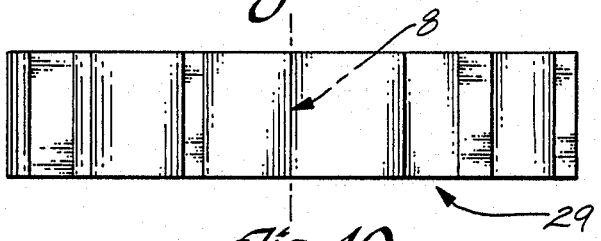
FIG. 9 is a front view of FIG. 8 along the line B—B.
Figure 10:
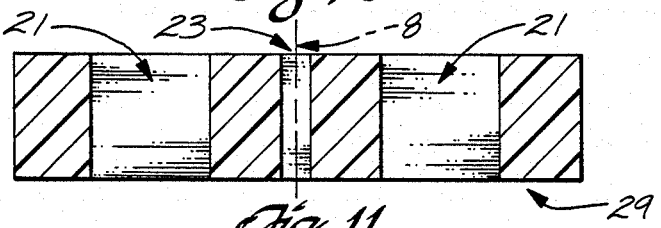
FIG. 10 is a cross-section of FIG. 8 along the line C—C.
Figure 11:
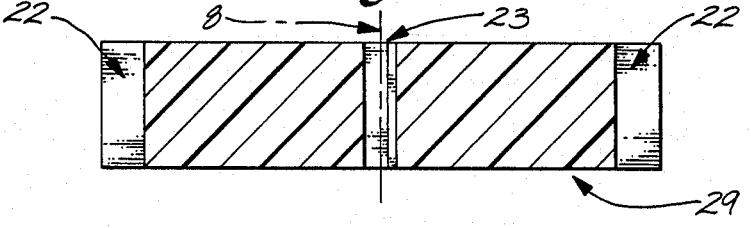
FIG. 11 is a cross-section of FIG. 8 along the line D—D.

FIG. 8 illustrates in the preferred embodiment the design of carriages 20, 20' and 20". As can be seen in FIG. 8, there are eight inner slots equi-angularly spaced about the axis of said carriage and there are eight equi-angularly spaced outer peripheral slots. As further shown in FIGS. 9, 10 and 11, the inner and outer slots extend vertically through the carriage. The inner slots are radially spaced about the axis of carriage 20 concentrically in an angular sequence of 45 degrees; the outer slots are also concentrically spaced radially about the axis in a radial sequence of 45 degrees. As can be seen from FIG. 8, the inner slots and outer peripheral slots form an alternating radial sequence of 22½ degrees. In the preferred embodiment, therefore, for each rotation of 22κ degrees of carriage 20, capsules contained in a respective inner or outer peripheral slot will be in alignment alternately with an outer peripheral aperture or inner aperture of dispensing gate 15. With each 22½ degrees of rotation of shaft 25, medicament capsules 11 contained in a slot which is in contiguous alignment with a gate aperture will pass downwardly through the dispensing gate aperture and ultimately dispensed to the patient through exit ramp 27 which communicates with dispensing gate apertures 12 and 13.

Relative to the operation of the preferred embodiment of the invention, it is first necessary to describe the loading of the carriages with capsules and the insertion of the dispensing gates and carriages into the housing. In this connection, referring to FIG. 1, in order to load the dispensing device, carriages 20, 20' and 20" are first removed from the housing along with dispensing gates 15, 15' and 15". Dispensing gate 15 has an axially centered hole 14 which is of sufficient diameter to clear the shaft 25. Upon insertion of tab 17 into channel 19 which is located on the housing innerwall 16, dispensing gate 15 is guided downwardly relative to shaft 25 and is precluded from further axial movement relative to housing 10 by butting against shoulder 28 which extends into the right cylindrical cavity 9 of housing 10. Carriage 20 in the preferred embodiment is thereafter inserted onto shaft 25 and directed downwardly along shaft 25 until the bottom face 29 of carriage 20 bears against dispensing gate 15. One of the outer peripheral slots 22, designated a, is aligned directly over the outer peripheral aperture 12 of dispensing gate 15. As can be seen in FIG. 1, slot a of carriage 20 contains no capsules. This corresponds to time zero condition for the dispensing device shown in FIG. 1. However, time zero may also be accomplished by unloading an inner slot and positioning that slot over the inner aperture of dispensing gate 15. Dispensing gate 15' is then inserted into housing 10 by aligning tab 17' with housing channel 19. The location of tab 17' on dispensing gate 15' determines the angular spacing of outer apertures 12 and 12' and inner apertures 13 and 13'. The angular spacing of the apertures contained in the dispensing gates will dictate those slots in carriages 20, 20' and 20'' which should not be loaded with medicament capsules at time zero.

Figure 12:
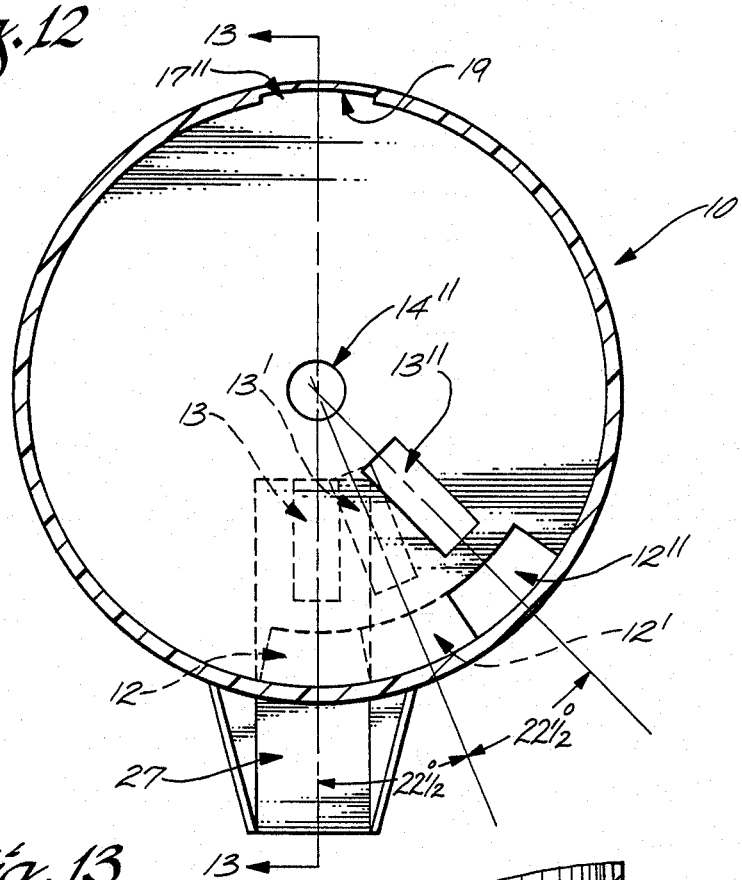
FIG. 12 is a sectional view of the preferred embodiment of the invention shown in FIG. 1, illustrating the sequential location of the apertures located in the dispensing gates.

In the preferred embodiment, as shown in FIG. 12, inner apertures 13, 13' and 13'' are angularly spaced in an axial sequence at angles of 22½ degrees and outer peripheral apertures 12, 12' and 12'' are angularly spaced at successive angles of 22½ degrees. The angular spacing of the apertures will determine those particular slots in carriages 20, 20' and 20'' which, at time zero, will be unloaded. In the preferred embodiment slots a, b', and c'' correspond to the unloaded slots at time zero. This is shown in FIG. 1. If the apertures in the dispensing gates are axially spaced at successive angles of 45 degrees, then the unloaded slots in the carriages would be slots a, b, c', d' and e''.

To complete the assembly process of the medicament dispensing device at time zero, carriage 20' is inserted onto shaft 25 and slid vertically downwardly along shaft 25 until the bottom surface 29' of carriage 20' bears upon the dispensing gate 15'. Similarly, dispensing gate 15'' is mounted within housing 10 along shaft 25 with the outer periphery of dispensing gate 15'' in contiguous tangential alignment with the innerwall 16 of housing 10. Carriage 20'' is thereafter inserted onto shaft 25 and moved in a downward vertical direction until the bottom surface 29'' of the carriage bears upon dispensing gate 15''.

Referring now to FIGS. 1, 2, 3 and 4, the operation of the device can be demonstrated. FIG. 1 represents a time zero condition before angular rotation of the shaft has occurred. FIGS. 2, 3 and 4 illustrate the position of the carriages after successive angular rotations of 22½ degrees of the shaft 25 in a counter-clockwise direction. As can be seen in FIG. 2, the capsules contained in slot p of carriage 20 have moved into contiguous alignment with aperture 12 of dispensing gate 15 after 22½ degrees of rotation of the shaft 25. Aperture 12 and the inner slots 21 of carriage 20 are so dimensioned and proportioned such that upon alignment of slot p with aperture 13 the capsules contained in slot p will pass downwardly through aperture 13 and be dispensed through exit ramp 27. Also, the medicament capsules contained in slot a' of carriage 20' will pass through outer peripheral aperture 12' into outer peripheral slot a. Similarly, the medicament capsules contained in slot b'' of carriage 20'' will pass through inner aperture 13'' of dispensing gate 15'' into slot b' of carriage 15'.

Referring now to FIG. 3, which represents a further sequential rotation of shaft 25 another 22½ degrees, the capsules contained in slot o of carriage 20 pass through outer peripheral aperture 12 and are dispensed through exit ramp 27. Those capsules contained in slot p' of carriage 20' will pass downwardly through inner aperture 13' of dispensing gate 15' for containment in slot p of carriage 20. Additionally, capsules contained in slot a'' of carriage 20' will pass through outer peripheral aperture 12'' in dispensing gate 15'' and be contained thereafter within slot a' of carriage 20'.

FIG. 4 further illustrates another 22½ degrees of rotation of shaft 25 in the capsule dispensing cycle. As can be seen in FIG. 4, the capsules contained in slot m of carriage 20 become aligned with inner aperture 13 of dispensing gate 15 and pass downwardly therethrough for dispensing through exit ramp 27. The capsules contained in slot o' will pass through outer peripheral aperture 12' in dispensing gate 15' and be contained within slot o of carriage 20. In a like manner, the capsules contained in slot p'' of carriage 20'' dispense through inner aperture 13'' in dispensing gate 15'' and are contained thereafter in slot p'. With the continued sequencing of shaft 25 for periods of 22½ degrees, the capsules in the manner previously described will pass from carriage 20'' into carriage 20' and thereafter into carriage 20 for eventual dispensing through inner aperture 13 and outer aperture 12 of dispensing gate 15.

Figure 14:
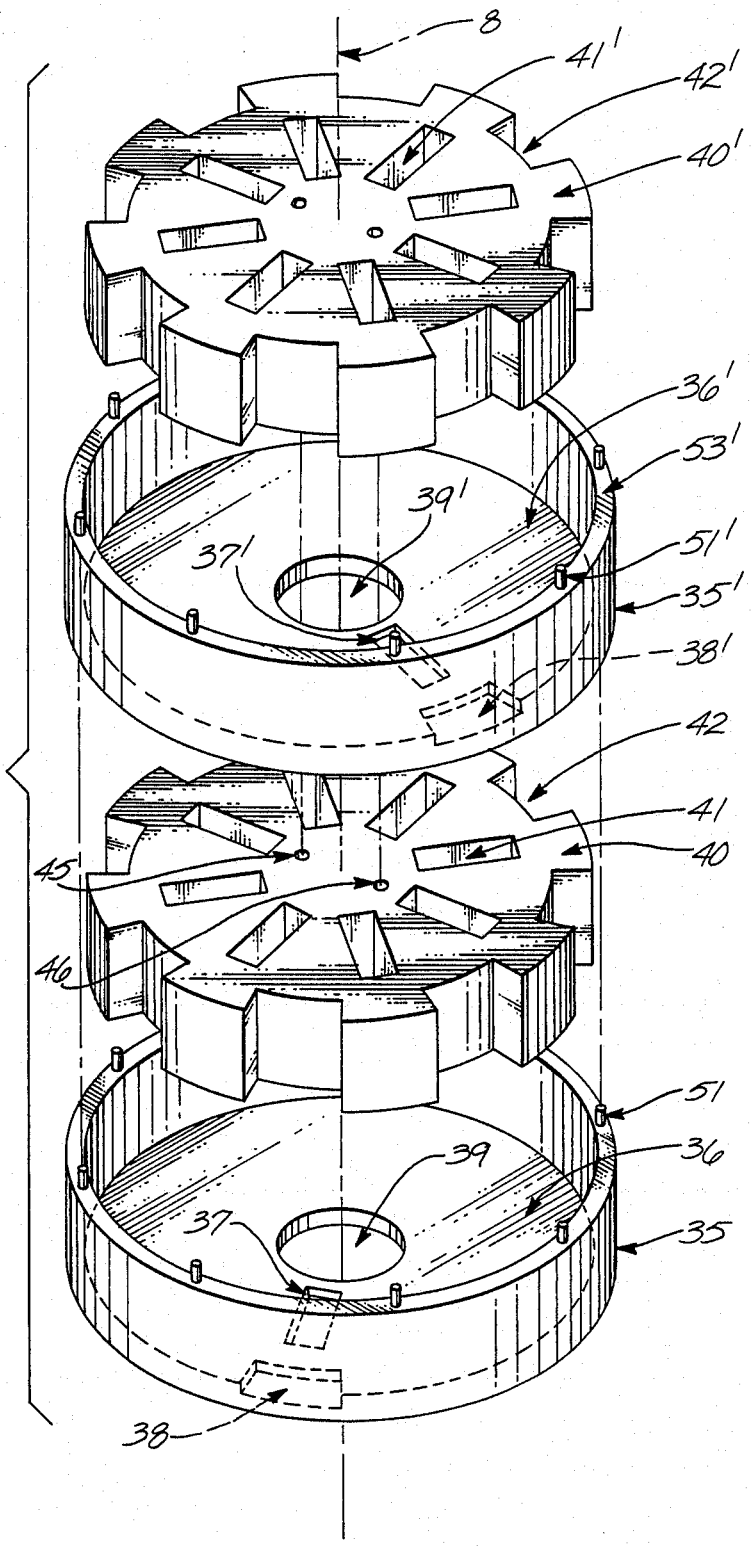
FIG. 14 is a exploded perspective illustration of another embodiment of the medicament dispensing device according to the present invention.

Another embodiment of the invention is shown in FIG. 14. In this embodiment, the housing is comprised of a series of cup shaped members 35 and 35' which are similarly constructed. Cup shaped members 35 and 35' form a right cylindrical shell with bases 36 and 36' which are transverse to the vertical axis of the cup members. Extending axially through base 36 is inner aperture 37 and outer peripheral aperture 38. As in the preferred embodiment of the invention, base 35 constitutes a dispensing gate having an inner and outer aperture for passage of capsules therethrough. The cup shaped members 35 and 35' have axially centered holes 39 and 39', respectively, which extend vertically through the respective bases. Carriages 40 and 40' are housed within cups 35 and 35' and said carriages contain slots which are located similarly to those slots contained in the carriages of the preferred embodiment of the invention. Carriage 40 contains inner slots 41 and outer peripheral slots 42. Likewise, carriage 40' has inner slots 41' and outer peripheral slots 42'. The transfer of capsules from carriage 40' through the apertures contained in cup member 35' for containment in slots 41 and 42 of carriage 40 occurs in the same manner as perviously described in the preferred embodiment of the invention.

Carriages 40 and 40' are connected for rotation by pins 43' and 44' which are shown in FIG. 16. Pins 43 and 44 extend through central hole 39' for reception by recepticles 45 and 46, thereby locking carriages 40 and 40' together for rotation. As shown in FIG. 16, pins 43 and 44 extend through hole 39 for engagement with coupling member 48 which is attached for rotation to motor means 49. Thus, rotation of coupling member 48 by programmable motor means 49 results in carriages 40 and 40' rotating at the same angular velocity as coupling member 48.

In the embodiment shown, cup shaped member 35 contains a plurality of fingers 51 with a like number of coupling cavities 52' contained at the periphery of the base of the cup shaped member 40' as shown in FIG. 16. Thus, the apertures 37 and 37' and 38 and 38' may be sequentially spaced in an angular sequence of degrees equivalent to 360 degrees divided by the number of coupling fingers 51, where the coupling fingers are equi-angularly spaced around the upper periphery 53 and 53' of cup shaped member 35 and 35'. In the embodiment shown, the cup shaped members have eight attachment fingers therefore permitting an angular spacing of 45 degrees between successive apertures.

While I have shown and described certain embodiments of the present apparatus, it is to be understood that it is subject to many modifications without department from the spirit and scope of the claims as recited herein.

What is claimed is:

1. A device for dispensing medicament capsules comprising:

(a) a housing having a vertical axis;

(b) a plurality of vertically spaced and substantially parallel dispensing gates removably disposed in said housing, a plurality of apertures extending vertically through each said gate, where said apertures in each said gate are spaced at different radial distances from said axis and so dimensioned and proportioned to permit the passage of capsules therethrough, and where said radial distances are of equal length in each one of said plurality of gates and said apertures located at equal lengths are axially spaced in a radial sequence of equal angles;

(c) a plurality of axially spaced carriage members removably carried by said housing where each said carriage member is individually reloadable and contiguous with at least one of said dispensing gates and where each said carriage member has a multiplicity of radially spaced slots for the selective placement of capsules extending vertically through said carriage members and where said slots are sequentially located concentrically about said vertical axis at said radial distances of said apertures and so dimensioned and proportioned to permit the passage of capsules contained in any slot downwardly through any said aperture in contiguous open alignment with said slot whereby upon the dispensement of capsules from said individual carriages said carriages may be removed from said housing and selectively reloaded with capsules;

(d) means for connecting said carriage members to permit vertical alignment of said radially spaced carriage member slots such that upon rotation of said carriage members said slots will remain in vertical alignment and relative rotation between said carriage members is precluded;

(e) programmable motor means carried by said housing for predetermined angular incrementation of said carriage members whereby upon open alignment of any said carriage member slot with any said dispensing gate aperture the capsules contained in said slot will pass downwardly through said dispensing gate.

2. The device for dispensing medicament capsules recited in claim 1 wherein said housing further comprises a cylindrical member having an axially extending cavity bounded by a cylindrical inside wall of said cylindrical member where said inside wall contains an axially extending channel.

3. A device for dispensing medicament capsules recited in claim 2 where said dispensing gates have a lateral protruberance extending from the lateral periphery of said gates for receipt in said channel to preclude relative rotation between said housing and said dispensing gates.

4. The device for dispensing medicament capsules recited in claim 3 where said means for connecting said carriage members comprises a non-circular shaft extending axially through each said carriage member where each said carriage member has an axially concentric non-circular hole extending vertically therethrough for receiving said shaft such that upon rotation of said shaft said carriage members will rotate at the same angular velocity as said shaft.

5. The device for dispensing medicament capsules recited in claim 4 where each of said carriages is of right cylindrical shape having an axis which is coaxial with said vertical axis.

6. The device for dispensing medicament capsules recited in claim 5 where one of said plurality of apertures in each said dispensing gate is an outer aperture located on the outer periphery of each said gate.

7. The device for dispensing medicament capsules recited in claim 6 where each one of said apertures located in each said gate is spaced at different radial distances on the same radius vector.

8. The device for dispensing medicament capsules recited in claim 1 where said housing comprises a series of cup shaped members where each said member comprises a transverse base defining a dispensing gate and a peripheral sidewall extending axially therefrom and, an attachment means for releasably locking said cup shaped members together.

9. The device for dispensing medicament capsules recited in claim 8 where said attachment means comprises a plurality of fingers extending axially from said sidewall and said base contains a plurality of coupling cavities for receiving said fingers such that upon insertion of said fingers into said coupling cavities said cup shaped members are releasably locked together.

10. The device for dispensing medicament capsules recited in claim 9 where the number of said fingers is equal to the number of said slots in any one of said plurality of carriages.

11. The device for dispensing medicament capsules recited in claim 9 where said carriages have a right cylindrical shape having an axis which is coaxial with said vertical axis.

12. The device for dispensing medicament capsules in claim 8 where said means for connecting said carriage members comprises a raised surface extending axially from said carriage and extending through an opening contained in said gate and so constructed and arranged to permit a releasable lock with a conjoining carriage member.

13. The device for dispensing medicament capsules recited in claim 12 where one of said plurality of apertures in each said dispensing gate is an outer aperture located on the outer periphery of each said gate.

14. The device for dispensing medicament capsules recited in claim 13 where each one of said apertures located in each said gate is spaced at different radial distances on the same radius vector.

15. An improved device for sequentially dispensing an assortment of medicament capsules of the type having a housing with a vertical axis, a plurality of vertically spaced and substantially parallel dispensing gates removably disposed in said housing, a plurality of apertures extending vertically through each said gate where said apertures in each said gate are spaced at different radial distances from said axis and so dimensioned and proportioned to permit the passage of capsules therethrough and said radial distances are of equal length in each one of said plurality of gates and where said apertures located at equal lengths are axially spaced in a radial sequence of equal angles, wherein the improvement comprises:

(a) a plurality of axially spaced carriage members removably carried by said housing where each said carriage member is individually reloadable and contiguous with at least one of said dispensing gates and where each said carriage member has a multiplicity of radially spaced slots for the selective placement of capsules extending vertically through said carriage member and where said slots are sequentially located concentrically about said vertical axis at said radial distances of said apertures and so dimensioned and proportioned to permit the passage of capsules contained in any said slot downwardly through any said aperture in contiguous open alignment with said slot whereby upon the dispensement of capsules from said individual carriages said carriages may be removed from said housing and said slots selectively reloaded with capsules;

(b) means for connecting said carriage members to permit vertical alignment of said radially spaced carriage member slots such that upon angular incrementation of said carriage members said slots will remain in vertical alignment and relative rotation between said carriage members is precluded;

(c) programmable motor means carried by said housing for predetermined angular incrementation of said carriage members whereby upon open alignment of any said carriage member slot with any said dispensing gate aperture the capsules contained in said slot will pass downwardly through said dispensing gate.

* * * * *